US005819681A

United States Patent [19]

Barnes et al.

[11] Patent Number: 5,819,681

[45] Date of Patent: Oct. 13, 1998

[54] ANCHOR FOR A PERSONAL WATERCRAFT

[76] Inventors: Bruce E. Barnes; Sharon E. Barnes, both of 601 Country Club Dr., Marshall, Tex. 75670

[21] Appl. No.: 675,869

[22] Filed: Jul. 5, 1996

[51] Int. Cl.[6] ..... B63B 21/24

[52] U.S. Cl. ..... 114/294

[58] Field of Search ..... 114/294, 270, 114/39.1, 121, 140, 65 A, 295–300; 106/733

[56] References Cited

U.S. PATENT DOCUMENTS

| | | | |
|---|---|---|---|
| 2,279,262 | 4/1942 | Edwards | 106/733 |
| 3,066,636 | 12/1962 | Churchman et al. | 114/300 |
| 3,799,098 | 3/1974 | Taylor et al. | 114/294 |
| 4,584,958 | 4/1986 | Green | 114/219 |
| 4,893,576 | 1/1990 | Day et al. | 114/219 |
| 4,951,592 | 8/1990 | Barongan | 114/294 |

*Primary Examiner*—Edwin L. Swinehart
*Attorney, Agent, or Firm*—John W. Adee

[57] ABSTRACT

An anchoring device, for use with a personal watercraft, having a tube containing layers of material including cement and a heavier material, preferably shot, used in a ratio which produces a predetermined weight. The tube is sealed with end caps. A shock absorber is positioned within the tube preferably between one of the end caps and the cement. One end cap has a fastener by which the anchoring device can be fastened to the personal watercraft. The tube and end caps are coated with a moisture and abrasion resistant material.

14 Claims, 3 Drawing Sheets

ANCHOR FOR A PERSONAL WATERCRAFT

FIELD OF THE INVENTION

This invention relates to an anchor for a personal watercraft particularly for use as an anchoring device for use in shallow water, and the combination of the anchoring device with a personal watercraft. The method of making the anchoring device is also disclosed.

BACKGROUND OF THE INVENTION

Personal watercraft, which includes jet skis and other jet craft, but are not limited thereto, are often used along beaches and other shore areas. These areas usually do not have facilities for mooring the watercraft. If one riding the watercraft wishes to leave the craft for some reason such as playing on the beach, then some type of anchor is required in order to prevent the watercraft from drifting away from where it is parked. Most manufactures recommend the craft be started in at least two feet of water to prevent sand and debris being sucked into the impeller. Also it is beneficial to prevent the watercraft from rubbing the bottom. Therefore the anchor should be designed to hold the watercraft in shallow water, usually of a depth of 2 to 3 feet.

One such anchor is a bag containing sand, gravel, rocks or some other weighting material. While these bags are successful in holding the watercraft, they have several disadvantages. One disadvantage is there is a tendency to overfill the bag, making it difficult to lift the bag from the water. Another disadvantage is the bag is wet and often dirty when pulled from the water. Unless it is cleaned each time it is used it may get the storage compartment, where it is stored, wet and dirty. However most people would prefer not to have to spend time cleaning a bag when thay could be enjoying themselves. A third disadvantage is the sand and gravel is very abrasive thus making it necessary to replace the bag often.

Small boat anchors have been used with these personal watercraft but they have the drawback that thay do not hold well in shallow water and are difficult to handle.

SUMMARY OF THE INVENTION

The present invention described and disclosed herein comprises an improved device for anchoring personal watercraft and is particularly useful is shallow water. The anchoring device consists of an elongated tube having a diameter of 2 to 4 inches and a length of 8 to 12 inches, with an end cap on each end for sealing the tube. One end cap is penetrated by a connecting means which is preferably an eye bolt. Washers are placed on both the external and internal surfaces of the cap and a fastener is placed below the internal washer for fastening the connecting means in place. A shock adsorbing means is positioned in the second cap. The shock absorbing means may be foam rubber, either natural or synthetic, a foam plastic or any other flexible material capable of absorbing the shock if the device is dropped on a hard object such as a rock or cement floor. The tube is filled with one or more materials that have a specific gravity several times the specific gravity of water. Preferably the material is concrete containing an aggregate and one or more layers of lead shot. Other materials having a high specific gravity could be used, for example barite, but the lead shot is preferred. The use of lead shot permits the device to be made smaller than would be the case if cement and aggregate were used alone. The weight of the anchoring device can be changed by varying the ratio of cement and aggregate to the amount of lead. A weight under 2 pounds will not hold the watercraft in place satisfactorily while a weight over 12 pounds has been found to be larger, and therefor more costly, than necessary. For these reasons the weight is preferably kept between 2 and 12 pounds. A weight of approximately 8 pounds has been found to give satisfactory holding power in adverse conditions and at an economical cost. The exterior of the tube and end caps are covered with a corrosive and abrasive resistant material. The coating material may be rubber, synthetic rubber or any of the well-known hard plastics suitable for this purpose. One such well known hard plastic is vinyl which is known to form a durable and abrasive resistant coating. At present a rubber coating is preferred because of the additional cost of the vinyl coating. Not only is the coating beneficial as a protector of the device but the coating also assists the shock absorber in reducing shock.

A flexible means such as a rope and more particularly a floating rope is attached at one end to the fastening means on the end cap. The other end of the rope is fastened to a snap suitable to be attached to a watercraft. The rope has a sliding float attached between the fastening means and the snap. The float can be slid along the rope as the anchoring device is lowered into the water so that it floats at the surface of the water when the device is on bottom. This makes it easy to spot the rope and retrieve the anchoring device. When the watercraft is in water so shallow that there is excess rope, the rope can be tied in a half hitch around the tube of the device.

The anchoring device is constructed by selecting a tube with a length and diameter within the range set forth above. Two caps are selected which are of a size to fit over and seal the tube. A hole is drilled approximately through the center of the first tube. An eye bolt or other fastening means is extended through a washer then through the first cap. A second washer is placed over the eye bolt on the underside of the first cap and the eye bolt is fastened by an ordinary nut or by a quick connect means. The first cap is then fastened to the tube either by a solvent or by plastic welding. Cement or cement containing an aggregate is then poured into the opposite end of the tube until the tube is filled ⅓ to ⅔ the tube length. Lead shot or other forms of lead are then poured into the tube to form a layer therein. The amount of lead is adjusted to give a desired weight within the ranges set forth herein. Next the tube is filled with the cement or cement and aggregate to within two to three inches of the end the foam shock absorber is then inserted into the tube and the end of the tube is sealed with the second end cap to complete the assembly. After the assembly is complete the entire anchoring device is inserted into the coating material several times to build up a coating at least 4 mil thick and as much as 24 mil thick with approximately 16 mil being preferred.

BRIEF DESCRIPTION OF THE DRAWINGS

For a more complete understanding of the invention and the advantages thereof reference is now made to the following description taken in conjunction with the accompanying drawings in which like numerals refer to like parts.

DETAILED DESCRIPTION OF THE PREFERRED EMBODIMENT OF THE INVENTION

Figure 1:
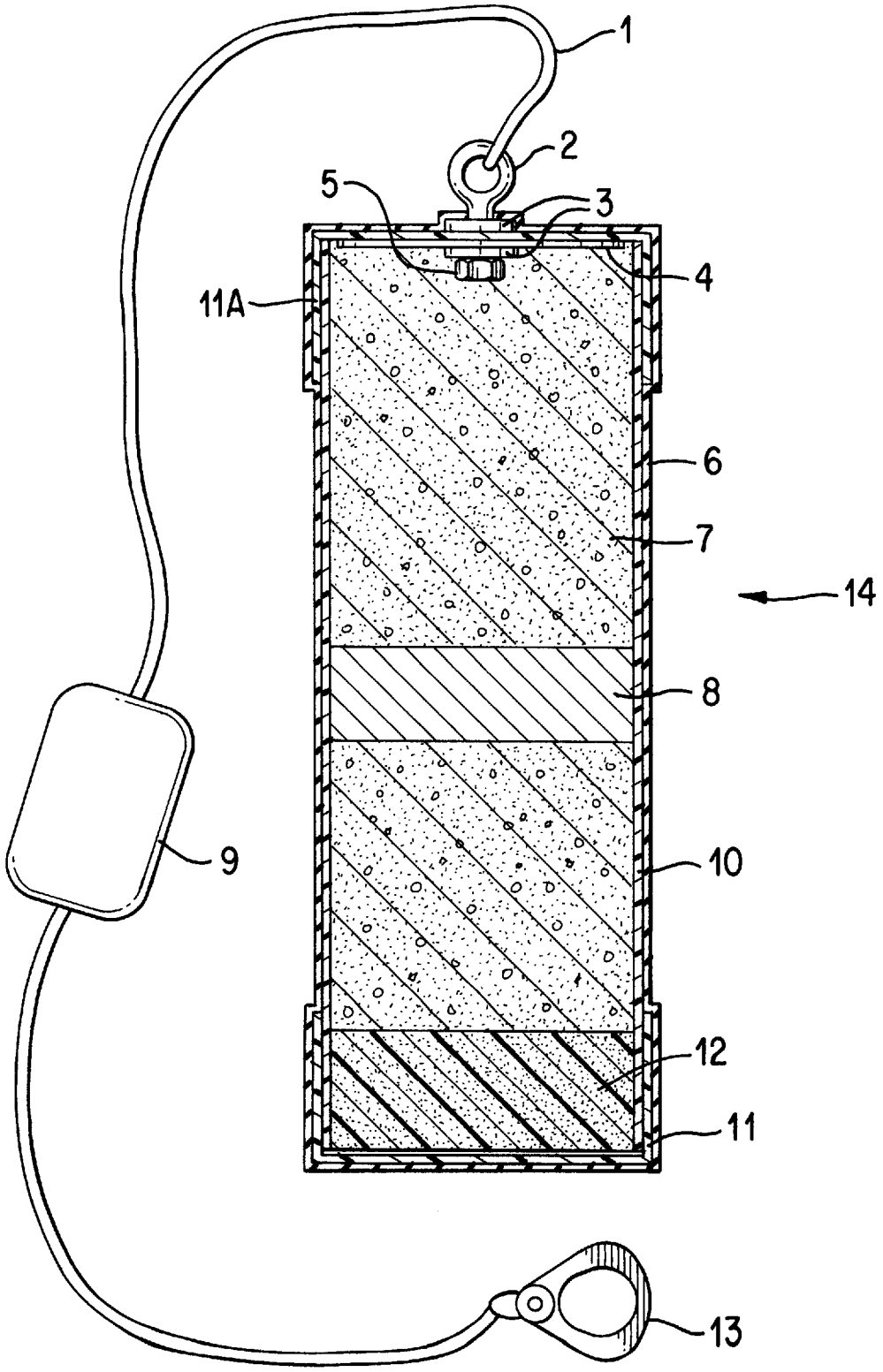
FIG. 1 illustrates the anchoring device of this invention.

FIG. 1 shows the personal watercraft anchoring device 14 having the following components. A rope 1, preferably a hollow braided rope approximately ¼" in diameter but larger diameters are usable and smaller diameters can be used providing they have sufficient strength to safely lift the anchoring device. The rope is fastened to an eye bolt 2 which is preferred to be a ¼" bolt but again both larger and smaller bolts are usable. A washer 3 surrounds the bolt. The inventors prefer a ¼" fender washer but the type and size are not critical. A second washer 4 is positioned below the first washer. For this washer the inventors prefers a larger diameter flat washer. Below the second washer and fastened to the bolt is a fastening means 5 that may be a common nut or a quick coupling. The body of the anchoring device 14 is made up of an elongated tube 10 having end caps 11 and 11 A. The tube 10 is preferably made of plastic, preferably poly vinyl chloride (PVC) pipe, however a metal tube could be used. The plastic tube is preferred because it cost less than metal, is not subject to rust and corrosion and with the shock absorber and coating in place it has sufficient strength to withstand abuse such as being dropped or hit with a heavy object. The end cap 11 closes the upper end of the tube and the bolt is inserted through end cap 11. The first washer is positioned on the upper surface of the cap and the second washer is positioned on the under surface of the cap but above the fastening means 5. The tube 10 could be of any practical length and diameter. It has been found, however, that the holding power of the anchoring device 14 is dependent on both size and weight. If the tube is less than 2" in diameter the holding power becomes much less unless the length is increased substantially. The extra length may cause storage problems. If the tube is greater than 4" in diameter then the weight becomes excessive and the cost much greater. When the tube is shortened to obtain a lighter weight then the anchor device becomes closer to a ball shape and does not hold as well. By trial and error the inventors have found that using a diameter of 2" to 4" to be preferred and a diameter of 3" to be most preferred. While lengths of 8" to 12" have proved suitable, a length of 10" has been determined to be the most desirable. The weight of the anchoring device 14 can be changed by changing the ratio of lead 8 to cement and aggregate 7. The tube 10 is filled with a heavy material 7 and is preferably divided into at least two parts by a very heavy material 8. The inventors use cement and aggregate as the heavy material 7 and lead shot as the very heavy material 8. Of course the lead could be chunks or even a solid piece but shot is preferred because it is readily obtainable. The weight of the anchoring device 14 can be changed by changing the ratio of lead 8 to cement and aggregate 7. While weights of 2 to 12 pounds have proven to give satisfactory results, a weight of about 8 pounds is the most practical when considering both cost and holding power of the anchoring device.

At the bottom of the tube, and flush against the cap 11A is a shock absorber 12. The shock absorber can be made of any foamed material that is flexible and will absorb shock. The inventors prefer to use foamed rubber or foamed synthetic rubber. The anchoring device 14 was dropped from a distance of over 50 inches on to a concrete floor, with the absorber 12 in place, without any damage. On the other hand a drop from 36 inches caused the anchoring device 14 to shatter when the shock absorber 12 was not present. The entire anchoring device is coated with a coating material 6 that is 4 to 24 mil thick, with 8 to 16 mil being found to give excellent strength and protection that protects the anchoring device 14 from abrasion and extends the life of the device many folds. The coating 6 also protects the watercraft from damage when the anchoring device 14 is in storage.

The rubber coating 6 used and preferred by the inventors has the following properties:

Elongation 400–500% ASTM D-683
Tensile strength 2600 psi
Shore A Hardness 65–75 ASTM D-149
Moisture Resistance: Excellent ASTM E-96
Salt Spray Test: Passed 1000 hrs ASTM B-117
Stone Abrasion: After 3–15 second cycles using #67 gravel, no damage ASTM D-3 170–174
Accelerated weather test: 10 yr. with a slight loss of thickness. ASTM G-53–84/3650 HRS A clip 13 is fastened to the end of the rope opposite the end fastened to bolt 2. This clip is preferably a swivel clip and is for the purpose of fastening the rope 1 to the watercraft. A sliding float 9 is positioned on the rope. This float 9 is slid along the rope 1 so that it is on the surface of the water as the anchoring device 14 is lowered. The float 9 thereby indicates the location of the anchoring device 14

Figure 2:
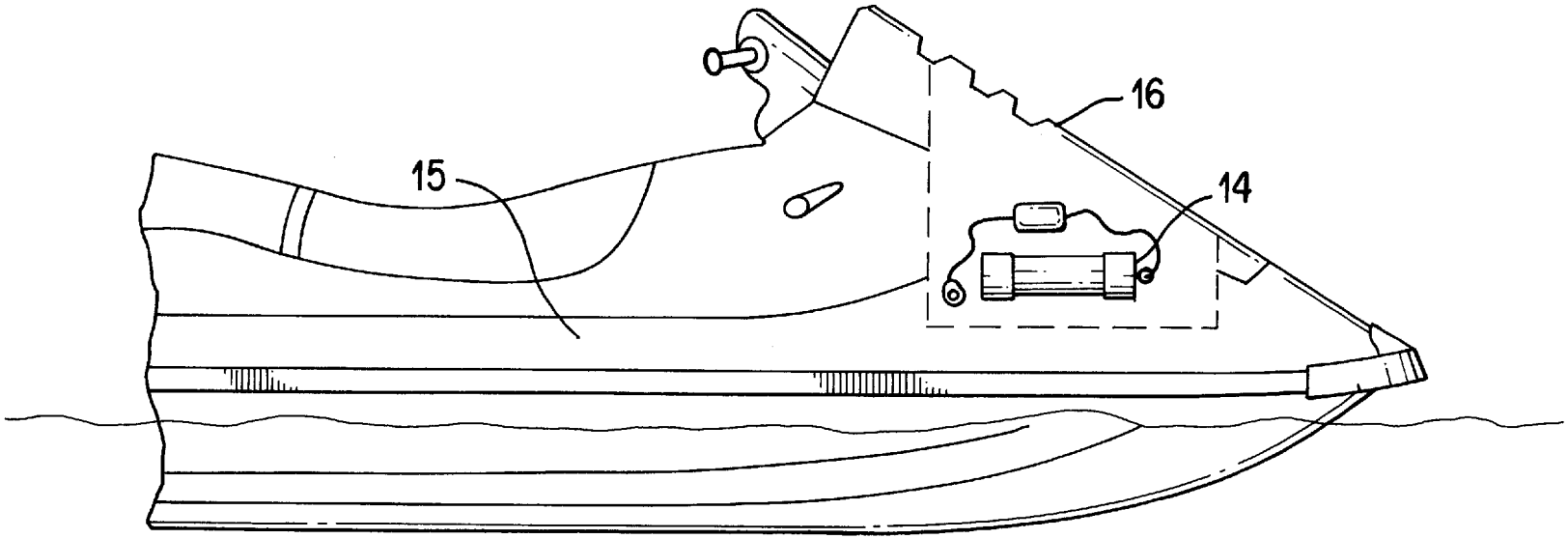
FIG. 2 illustrates the anchoring device in the storage compartment of a personal watercraft.
Figure 3:
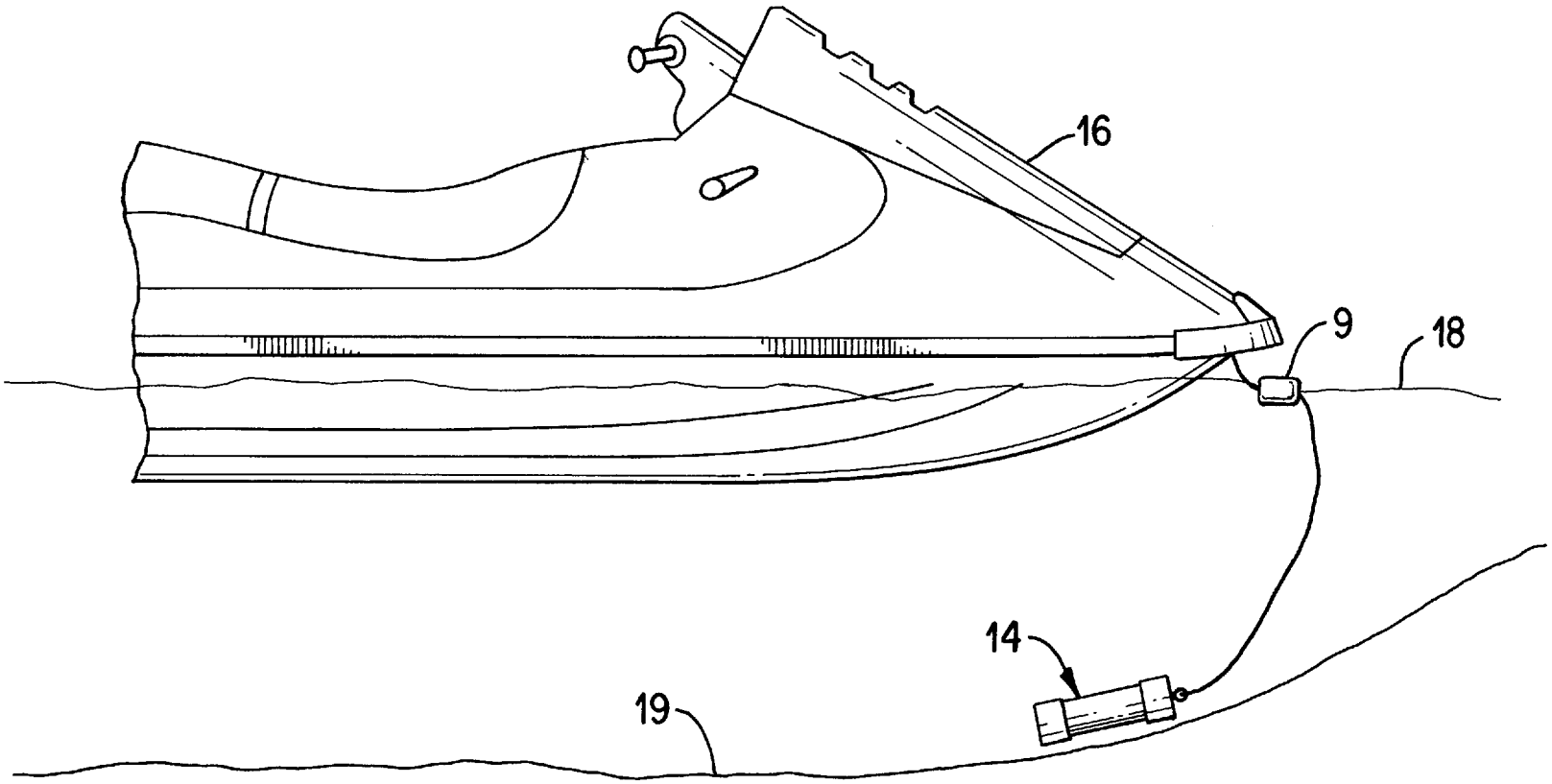
FIG. 3 illustrates the anchoring device deployed in shallow water.

The numeral 15, see FIG. 2, illustrates a watercraft having a storage compartment 16. The anchoring device 16 is illustrated in the storage compartment 16. In FIG. 3 the watercraft is anchored in the water using the anchoring device 14. The water surface is shown at 18 and the bottom of the body of water is illustrated at 19. The preferred depth for anchoring is 2 to 3 feet. Since the watercraft, per se, is well known and is not part of the invention, it has not been described in detail. The combination of the watercraft and anchoring device is part of the invention. Although the description above contains many specificity's, these should not be construed as limiting the scope of the invention but as merely providing illustrations of some of the presently preferred embodiments of this invention.

Thus the scope of the invention should be determined by the appended claims and their legal equivalents rather than by the given examples.

We claim:

1. An anchoring device for a personal watercraft, said anchoring device comprising a tube, a first end cap and a second end cap closing said tube, said first end cap having a fastening means for fastening a rope to the anchoring device; a shock absorbing material placed in said second end cap and a weighting material placed between the absorbing material and the first end cap; said anchoring device being of sufficient size and weight to hold a personal watercraft in shallow water.

2. The anchoring device of claim 1 wherein the weighting material includes cement with at least one layer of lead separating the cement into parts.

3. The anchoring device of claim 2 wherein the lead is lead shot and the cement contains an aggregate.

4. The anchoring device of claim 1 wherein the fastening means for fastening a rope is an eye bolt extending through a washer then through the cap then through a second washer then into a means for holding the eye bolt to the anchoring device.

5. The anchoring device of claim 1 further comprising the exterior of the anchoring device being covered with an abrasion and moisture resistant coating.

6. The anchoring device of claim 4 further including a rope fastened to the eye bolt and a float slidable along the rope so that the float can be set to float on the surface and further a snap on the other end of the rope for fastening the anchoring device to a watercraft.

7. The anchoring device of claim 1 wherein the weighting material includes cement and at least one layer of shot separating the cement into parts.

8. The anchoring device of claim 1 wherein the tube, the first end cap and the second end cap are made of a plastic material.

9. An anchoring device including a tube made with a plastic material, a first end cap and a second end cap closing said tube, said first end cap having a fastening means for fastening a rope to the anchoring device, a shock absorbing material placed in said second end cap and a weighting material placed between the absorbing material and said first end cap, said tube being at least eight inches but no greater than twelve inches in length, further said tube being between 2 inches and 4 inches in diameter, said material being selected to produce a weight of at least two pounds but no greater than twelve pound for the anchoring device.

10. The device of claim 9 further including said anchoring device being coated with a material which is capable of resisting moisture and abrasion.

11. The anchoring device of claim 10 further including said tube having the following properties: a length of approximately 10 inches, a diameter of approximately 3 inches and a weight of approximately 8 pounds.

12. A method of making an anchor for a personal watercraft comprising the following steps:

Step 1, selecting a plastic tube at least 8 inches long but no longer than 12 inches long and having a diameter no less than 2 inches and no greater than 4 inches;

Step 2, selecting two end caps of a size to fit over and seal the tube;

Step 3, drilling a hole approximately the center of one end cap for receiving a fastening means which can be fastened to a rope;

Step 4, securing the fastening means to the first end cap and sealing said cap to the tube;

Step 5, filling the tube ⅓ to ⅔ of its length with a mixture consisting of cement;

Step 6, pouring a sufficient amount of lead into the tube to obtain a weight of 2 to 12 pounds for the completed anchoring device;

Step 7, pouring an additional amount of the mixture consisting of cement to fill the tube to within 2 to 3 inches of the end;

Step 8, inserting a foam shock absorber into the tube;

Step 9, sealing the tube with the second end cap,

Step 10, inserting the anchoring device into a coating material until at least a 4 mil thickness of coating is obtained.

13. The method of claim 12 including the coating being a rubber coating or a vinyl coating.

14. The method of claim 12 wherein the shock absorber is made with rubber.

* * * * *